US010501301B2

(12) United States Patent
Cortesi

(10) Patent No.: US 10,501,301 B2
(45) Date of Patent: Dec. 10, 2019

(54) METHOD FOR DETECTING THE DEFECTIVE STATUS OF AN ARTICLE TO BE CONTACT FILLED WITH A POURABLE PRODUCT AND FILLING DEVICE

(71) Applicant: Sidel Participations, Octeville-sur-Mer (FR)

(72) Inventor: Andrea Cortesi, Parma (IT)

(73) Assignee: SIDEL PARTICIPATIONS, Octeville-sur-Mer (FR)

( * ) Notice: Subject to any disclaimer, the term of this patent is extended or adjusted under 35 U.S.C. 154(b) by 300 days.

(21) Appl. No.: 15/408,356

(22) Filed: Jan. 17, 2017

(65) Prior Publication Data

US 2017/0225932 A1 Aug. 10, 2017

(30) Foreign Application Priority Data

Feb. 8, 2016 (EP) ..... 16305145

(51) Int. Cl.

| | |
|---|---|
| ***B67C 3/00*** | (2006.01) |
| ***B65C 3/26*** | (2006.01) |
| ***B67C 3/20*** | (2006.01) |
| ***B67C 3/24*** | (2006.01) |
| ***B67C 3/28*** | (2006.01) |
| ***B67C 3/10*** | (2006.01) |

(52) U.S. Cl.

CPC ..... *B67C 3/007* (2013.01); *B65C 3/26* (2013.01); *B67C 3/10* (2013.01); *B67C 3/20* (2013.01); *B67C 3/24* (2013.01); *B67C 3/286* (2013.01)

(58) Field of Classification Search

CPC .. B67C 3/007; B67C 3/26; B67C 3/20; B67C 3/24; B67C 3/286; B67C 3/10

See application file for complete search history.

(56) References Cited

U.S. PATENT DOCUMENTS

| | | | | |
|---|---|---|---|---|
| 2,606,657 | A | 8/1952 | Berthelsen | |
| 9,963,335 | B2 * | 5/2018 | Clusserath | B67C 3/007 |

FOREIGN PATENT DOCUMENTS

| | | | |
|---|---|---|---|
| DE | 19703528 | A1 | 8/1998 |
| DE | 102013100702 | A1 | 7/2014 |
| EP | 1661848 | A1 | 5/2006 |
| EP | 1897848 | A1 | 3/2008 |

* cited by examiner

*Primary Examiner* — Timothy P. Kelly

(74) *Attorney, Agent, or Firm* — Finnegan, Henderson, Farabow, Garrett & Dunner LLP

(57) ABSTRACT

A method for detecting the defective status of an article intended to be contact-filled with a pourable product stored in a tank using a filling device includes creating a tight-fluid contact between an opening of an article and a first fluidic line defined by the filling device; setting a second valve in a second closed position; setting a first valve in a first open position; measuring the flow of the pourable product along the first fluidic line; and detecting that the article is defective if the flow is greater than a threshold value.

15 Claims, 7 Drawing Sheets

METHOD FOR DETECTING THE DEFECTIVE STATUS OF AN ARTICLE TO BE CONTACT FILLED WITH A POURABLE PRODUCT AND FILLING DEVICE

This application claims priority to European Patent Application EP16305145.1, filed on Feb. 8, 2016, the contents which are incorporated herein by reference in their entirety.

The present invention relates to a method for detecting the defective status of an article to be contact filled with a pourable product.

The present invention also relates to a filling device for contact filling an article with a pourable product.

As is known, many pourable food product comprising not only food product like milk, fruit juice or beverages in general, but also detergents are sold in articles having different shapes and dimensions.

These articles are typically made within bottling units, which comprise a plurality of stations for carrying out respective operations on the articles.

Very briefly, the bottling unit comprises, in the following sequence, at least one blowing station for blowing a plurality of pre-forms and forming relative articles, one filling unit for filling the articles with a pourable food product, one capping station for applying a plurality of caps onto the respective articles and one labeling station for applying labels onto the outer surface of respective articles.

In the traditional solutions, the labeling station is arranged downstream of the filling station and the bottling unit further comprises a plurality of rectilinear/curvilinear transfer elements, e.g. rectilinear guides and/or star-wheels, for transferring the articles from the filling station to the labeling station.

In the most recent technical solutions, the filling station, the capping station and the labeling station are enclosed in only one machine.

In both the cases, a need is felt within the sector to detect the defective status of the articles, in particular the presence of a hole in the filled articles, before the latter are transferred to the labeling station. This need is especially felt when very light pre-forms are employed for obtaining respective articles. This is because there is the risk that very small holes are formed in these very light pre-forms and that these very small holes are not properly detected when the pre-forms output the blowing station.

As far as the traditional solutions are concerned, the defective articles are likely to fall over the output conveyor of the filling station, thus causing the jamming of the overall unit.

The need is even more felt in the case of the previously described most recent technical solutions. As a matter of fact, due to the very reduced size of the machine, the holed articles are likely to sprinkle the pourable product inside the labeling station, thus causing the jamming thereof.

It is an object of the present invention to provide a method for detecting the defective status of an article intended to be contact filled with a pourable product stored, which solves the above-identified need.

The aforementioned object is achieved by the present invention as it relates to a method for detecting the defective status of an article intended to be contact filled with a pourable product, as claimed in claim 1.

The present invention also relates to a filling device for contact filling an article with a pourable product, as claimed in claim 9.

One preferred embodiment is hereinafter disclosed for a better understanding of the present invention, by way of non-limitative example and with reference to the accompanying drawings, in which.

Figure 6:
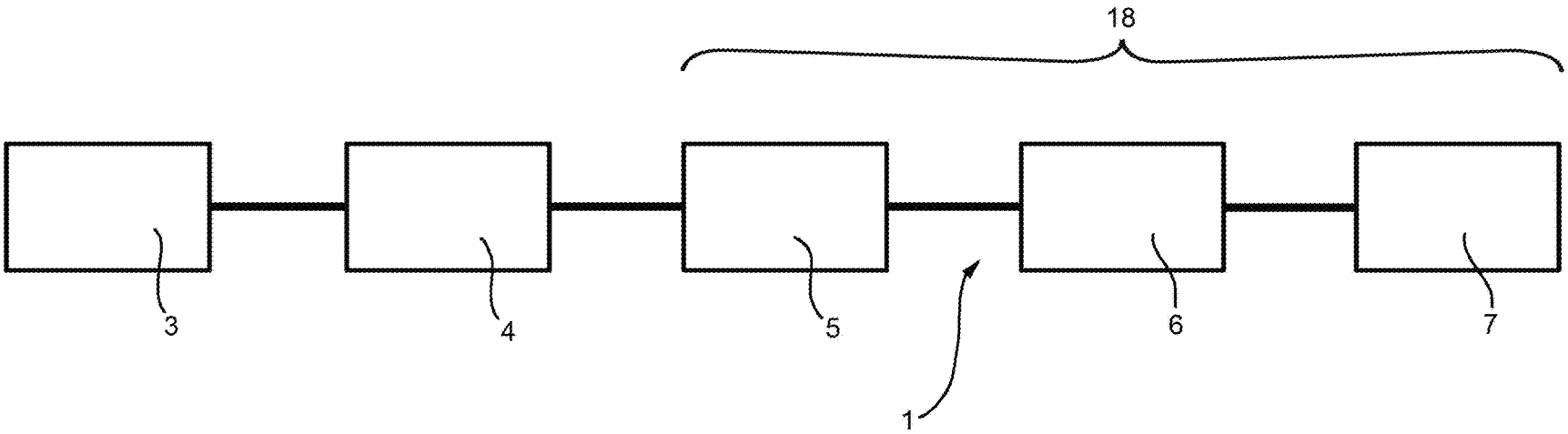
FIG. 6 is a schematic view of a unit for manufacturing articles filled with a pourable product in accordance with the present invention, with parts removed for clarity.
Figure 7:
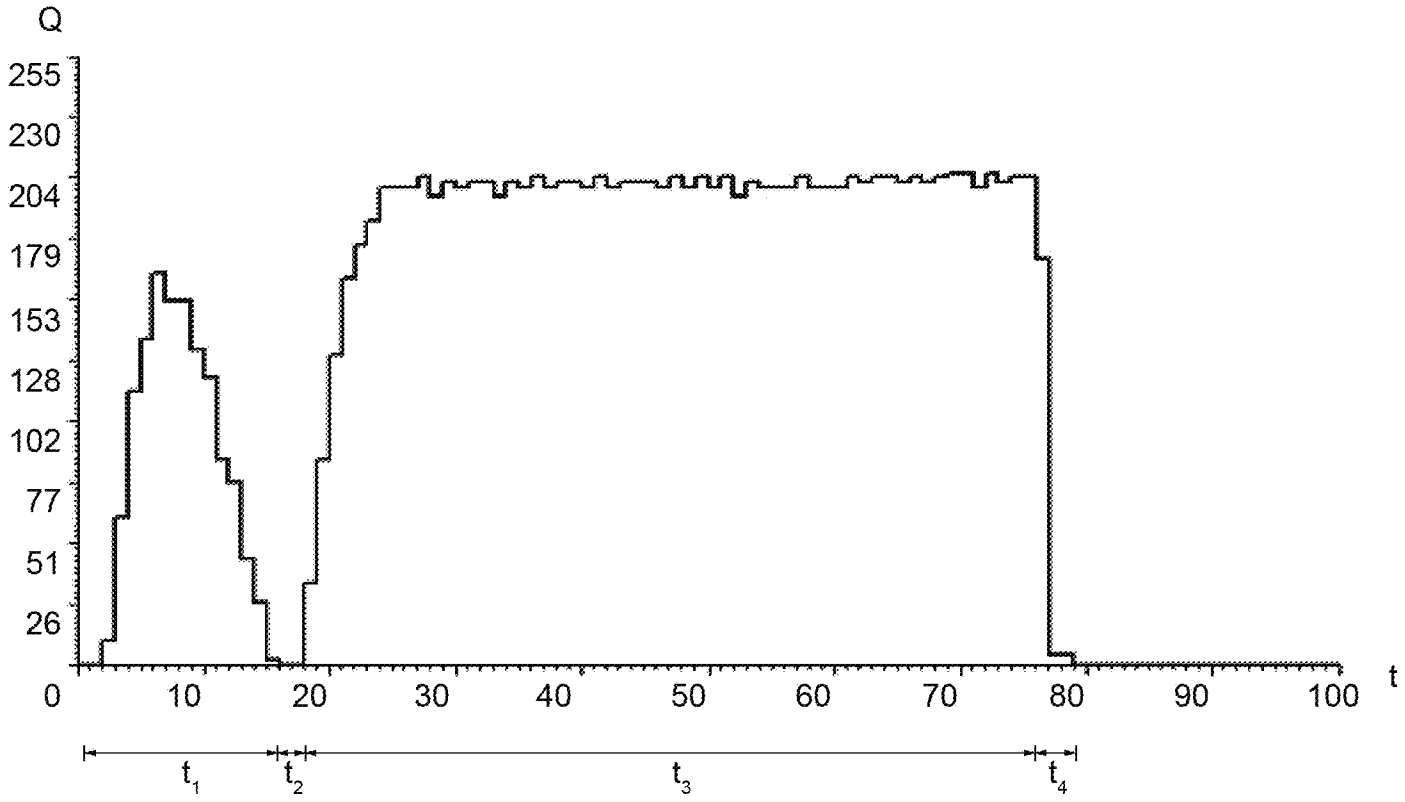
FIG. 7 is a graph showing the plot of the flow detected by a flow-meter of the filling device during the time.

With reference to FIG. 6, numeral 1 indicates as a whole a unit for manufacturing articles 2 with a pourable product.

Unit 1 comprises, in sequence and in this sequence, (FIG. 1):

- a blowing station 3 for blowing articles 2 starting from respective not-shown pre-forms;
- a filling station 4 for filling articles 2 with the pourable product;
- a capping station 5 for applying a plurality of caps onto relative articles 2; and
- a labeling station 7 for applying relative labels onto articles 2.

Furthermore, unit 1 comprises a transfer station 6 for transferring articles 2 along a curved transfer path and from capping station 5 to labeling station 7.

In the embodiment shown, filling station 4, capping station 5, labeling station 7 are defined by only one machine 18.

An example of this machine is shown in the European applications 15164939 and 15164940 in the name of the same Applicant.

Each article 2 comprises (FIGS. 1 to 5), in a known manner:

- a mouth 8, through which article 2 is filled by filling station 4, and the pourable product is subsequently poured from article 2;
- a bottom wall 9*a*, which is opposite to mouth 8; and
- a neck 9*b*, which is extends from mouth 8 towards bottom wall 9*a* and is detached by bottom wall 8.

Filling station 4 comprises, in turn:

- a carousel (not-shown), which is rotatable about an axis, which is in vertical, in use, and defines a plurality of peripheral seats for receiving relative articles 2;
- a plurality of filling devices 17, which are fitted to a periphery of the carousel; and
- a tank 13 which is filled with the pourable product.

In the following of present description, only one filling device 17 will be described, being the other ones identical.

With reference to FIGS. 1 to 5, filling device 17 is adapted to contact filling a relative article 2, with a pourable product, which can be selectively either carbonated or still, i.e. not carbonated.

Filling device 17 substantially comprises:

- a body 10 defining a cavity 11, which has an opening 12 fluidly connected with a tank 13 and defining, on the opposite side of opening 12, a filling opening 14;
- a shutter 15, which is movable parallel to an axis A inside cavity 11 between an open position in which it fluidly connects openings 12, 14 and a closed position in which it fluidly isolates openings 12, 14; and
- a support 20 which is adapted to contact wall 9*a* so as to arrange an axis of article 2 parallel to axis A and is movable between a rest position and an operative position along axis A.

Support 20 is carried by the outer periphery of carousel in a position below body 10.

Axis A of filling device 17 is spaced from and parallel to the axis of rotation of carousel.

Support 20 receives a relative empty article 2 at an inlet station (not-shown), convey relative article 2 along an arc-shaped trajectory, and output filled article 2 at an outlet station (not-shown).

Support 20 is movable parallel to axis A between:

- a lowered rest position (FIG. 1), in which mouth 8 is spaced along axis A by body 10 and opening 14 of filling device 17; and
- a raised operative position (FIGS. 2 to 5), in which mouth 8 is in tight-fluid contact with body 10 and opening 14 of filling device 17, through the interposition of an annular gasket 16.

In particular, support 20 is arranged in the relative rest position at inlet station and at the outlet station, and moves from the rest position to the lowered position and vice-versa along the arc-shaped trajectory.

Very briefly, in case of filling with a carbonated pourable product, article 2 preferably undergoes the following operations according the so-called contact filling modality:

- a vacuum generation step, during which vacuum is generated inside the inner volume of article 2 with the shutter 15 in the closed position, so as to prevent the risk of oxidation of the pourable product;
- a pressurization step, during which the inner volume of article 2 is pressurized to the same pressure as the pourable product during the filling process with shutter 15 in the closed position, for example by feeding a pressurizing fluid, e.g. carbon dioxide, into it (FIG. 3);
- a filling step, during which shutter 15 moves to the open position, so as to fill article 2 with the pourable product, so as to fill article 2 according to the so-called "contact" modality, i.e. by isolating the inner volumes of cavity 11 and the inner volume of article 2 by the external environment during the filling of article 2; and
- finally a de-pressurization step, during which the inner volume of neck 9*b* of article 2 is de-pressurized to the environment pressure with shutter 15 in the closed position, e.g. by connecting the inner volume of article 2 to a discharge.

It is important to stress that not all the above-identified operations are necessarily carried out before or after the filling of article 2 with carbonated pourable product, and that some operations, e.g. the vacuum generation step and the pressurization step, can be repeated more than once.

In case of filling of article 2 with a still product, the vacuum generation pressurization, and de-pressurization steps are not carried out.

Body 10 further comprises:

- a fluidic line 19, which extends between opening 14 and a collector 21 filled with the pressurizing gas
- carbon dioxide—in the embodiment shown—and is adapted to allow the flow of the pressurizing fluid before the filling of article 2 or the return of the aeriform contained inside article 2 during the filling of article 2 in case of filling with a carbonated product; and
- a pair of valves 22, 23 interposed along fluidic line 19.

In greater detail, fluidic line 19 comprises:

- a duct 24 extending parallel to axis A and coaxially with opening 14, cavity 11 and shutter 15; and
- a duct 25, which extends radially to axis A inside body 10, above cavity 11 and from a section 26 of duct 24 to a section 27;
- a pair of ducts 28, 29, which extend between section 27 and collector 21.

In case of filling with a carbonated product, valves 22, 23 are arranged along relative ducts 28, 29.

Figure 1:
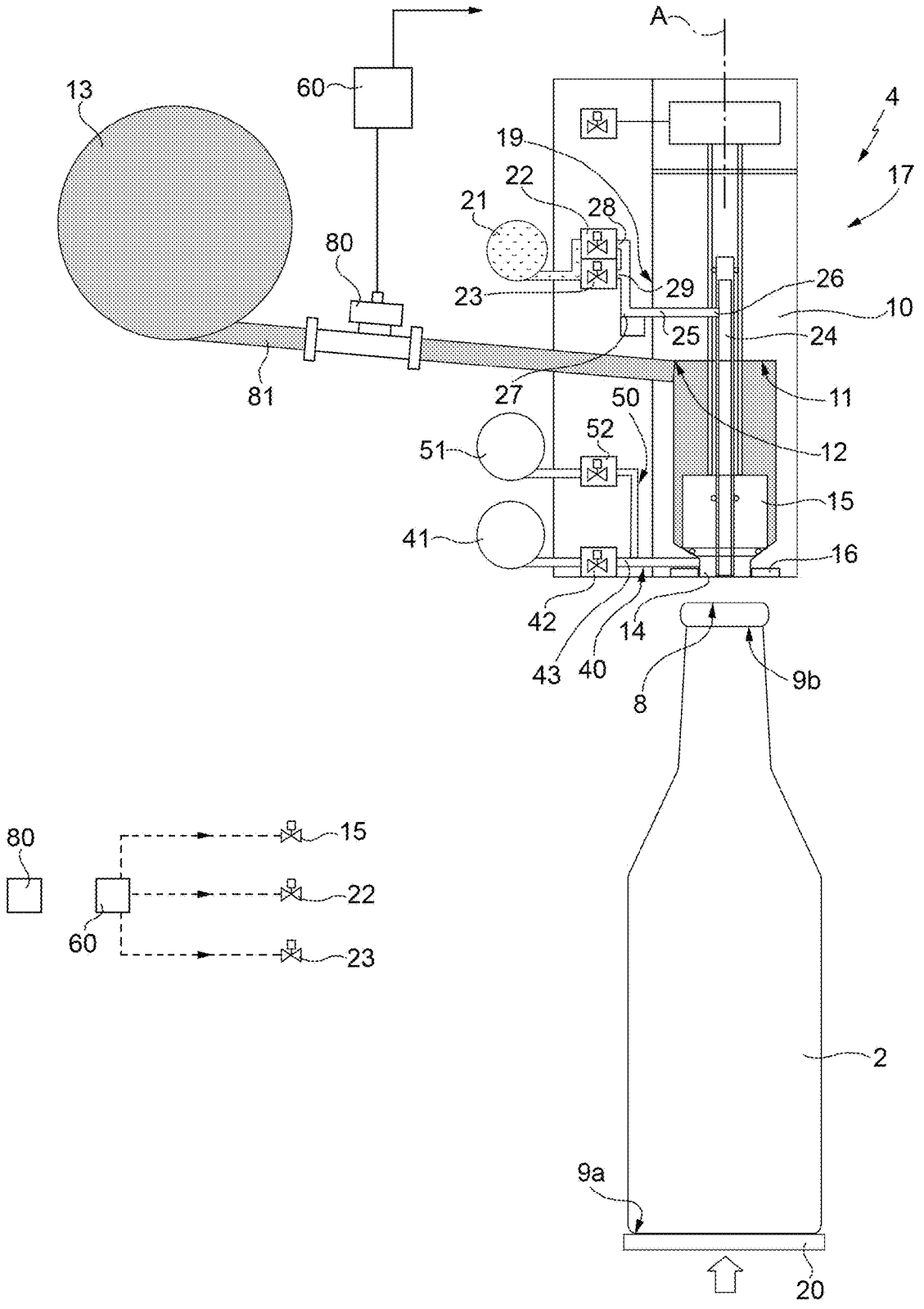
FIG. 1 to 5 show a filling device according to the present invention and in respective operative positions.
Figure 2:
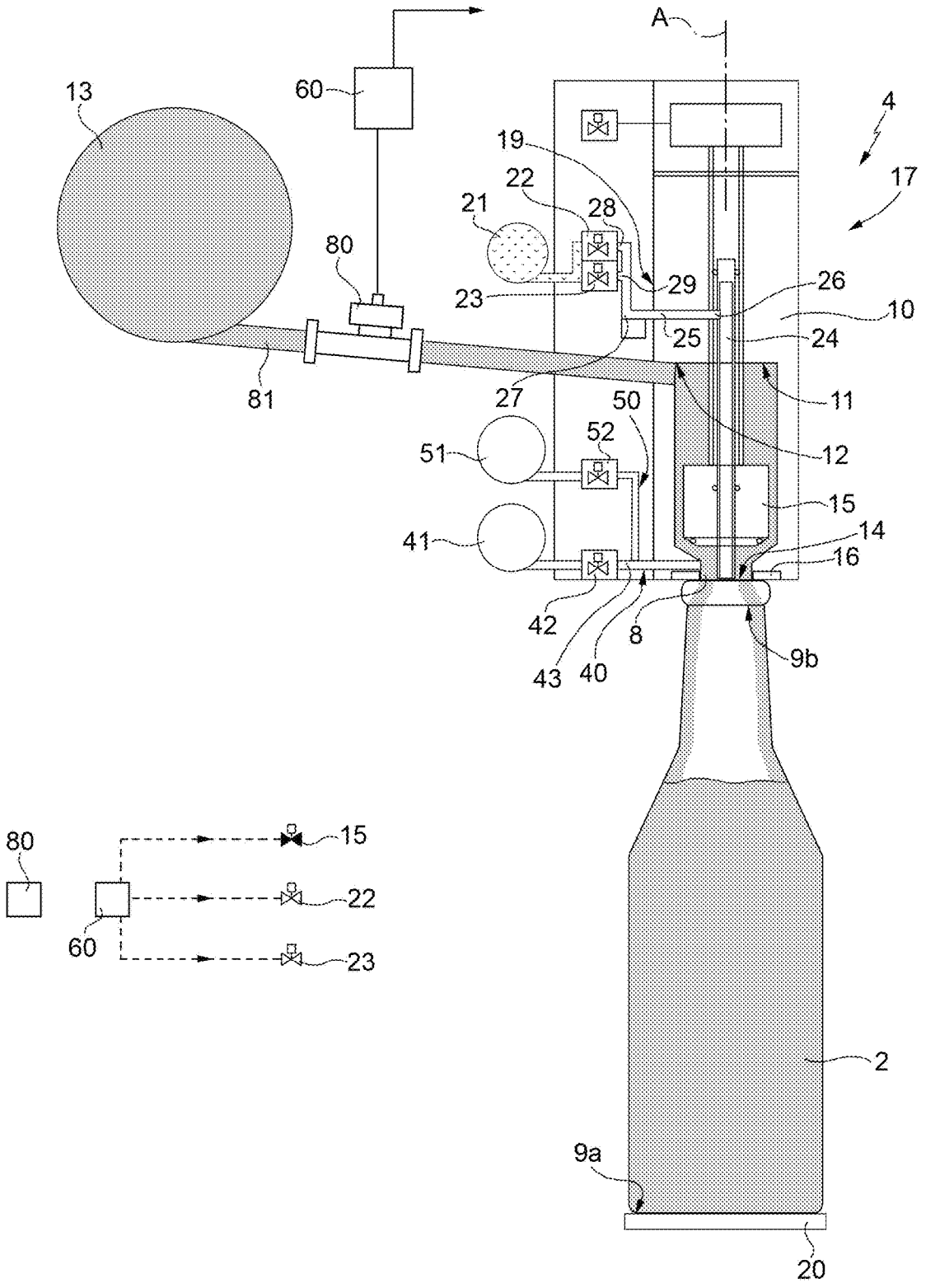
Figure 3:
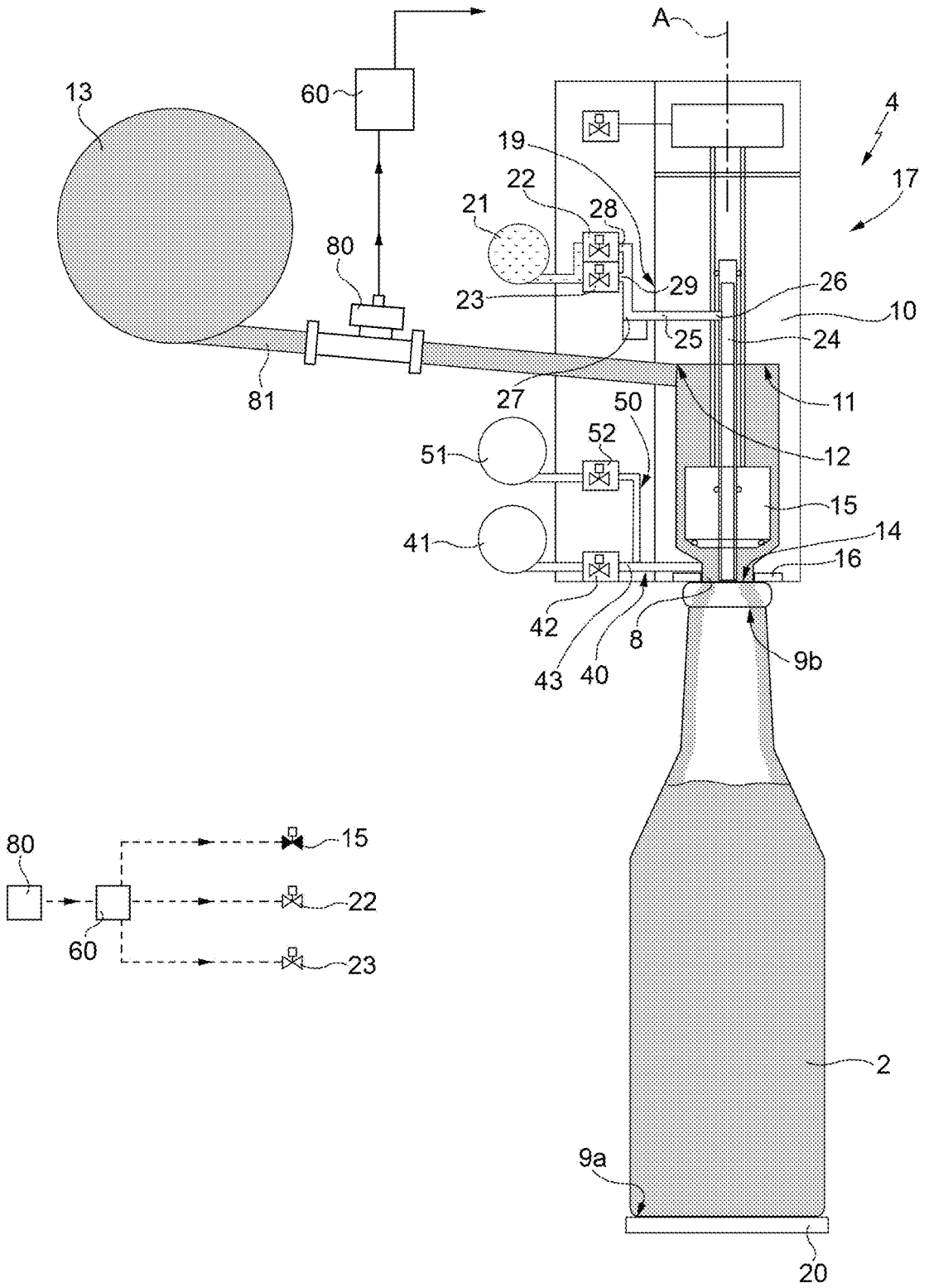
Figure 4:
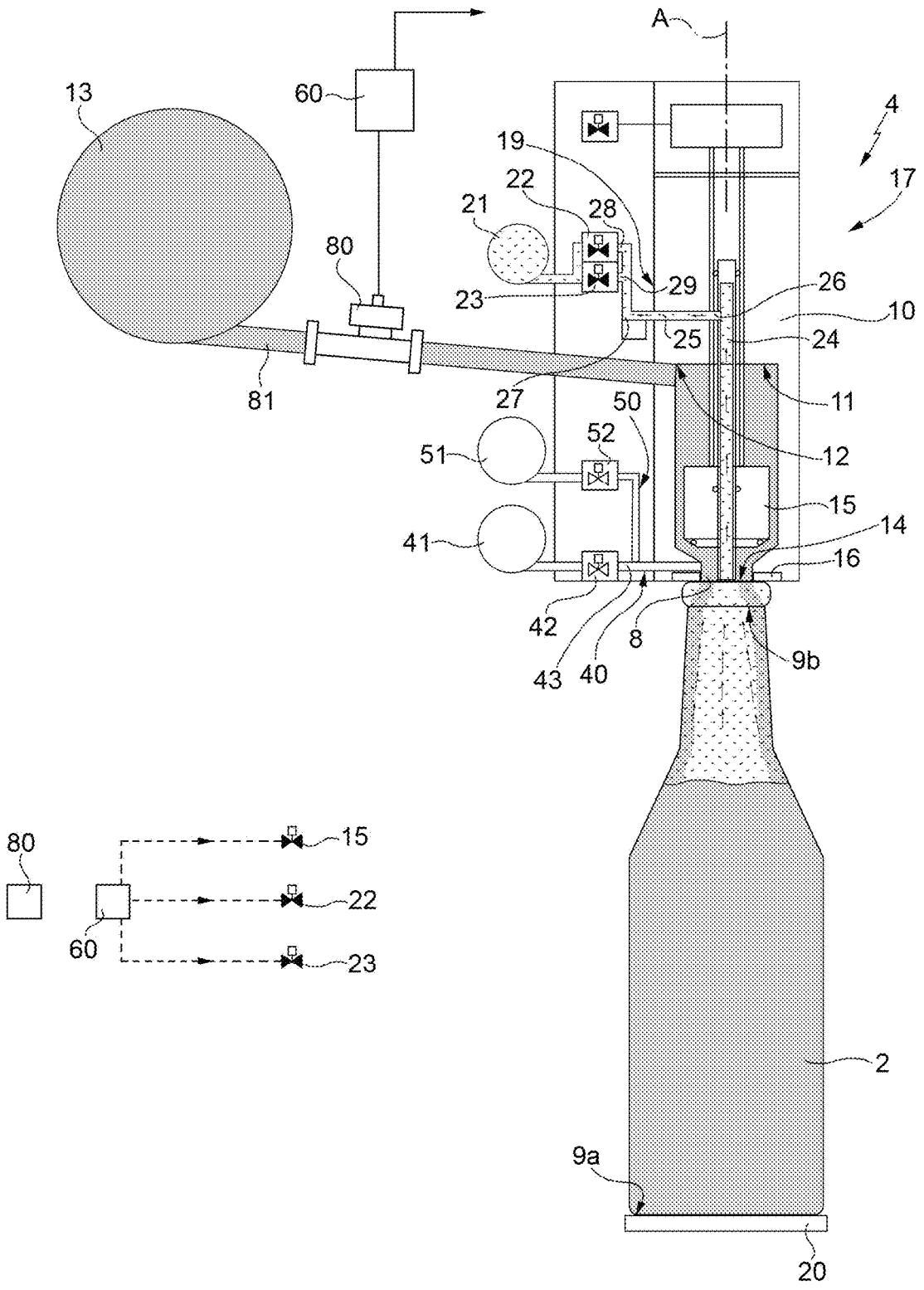
Figure 5:
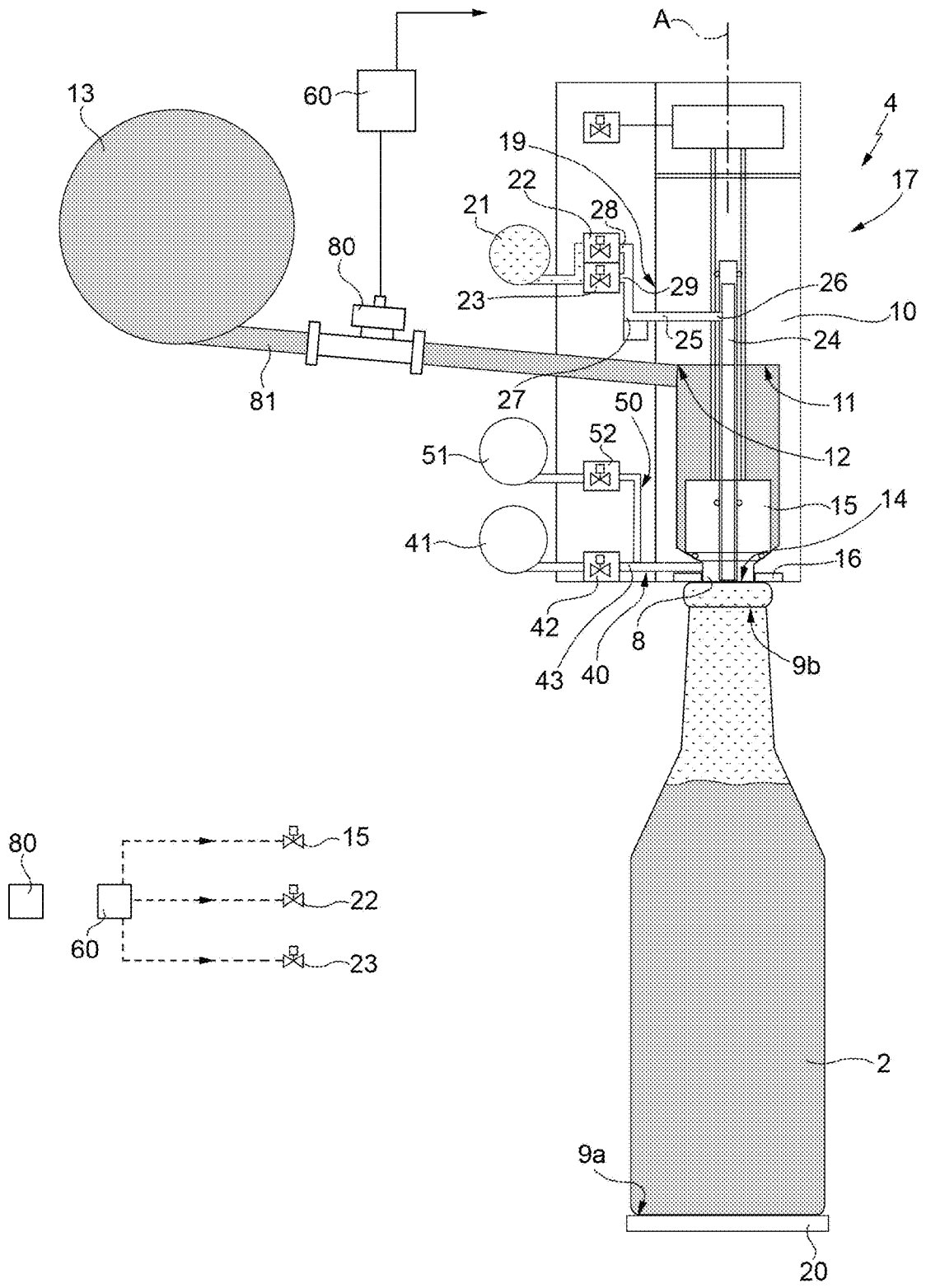

In greater detail, valves 22, 23 can be selectively set in:

- respective open positions, in which they fluidly connect section 27 with collector 21 along respective ducts 28, 29 (FIGS. 4 and 5 with reference to valve 22 and FIG. 4 with reference to valve 23); or
- respective closed positions, in which they fluidly prevent the flow from between section 27 and collector 21 along respective ducts 28, 29 (FIGS. 1, to 3 with reference to valve 22 and FIGS. 1 to 3 and 5 with reference to valve 23).

In the drawings accompanying the present description, valves (not only valves 22, 23) are depicted in white when set in respective closed positions and are depicted in black when set in respective open positions.

In case of filling with a carbonated product, valves 22, 23 are set in the respective open positions, during the pressurization step of article 2, while they are set in the respective closed positions when the vacuum-generation step and during the de-pressurization step.

Body 10 further comprises:

- a fluidic line 40, which extends between opening 14 and a discharge collector 41; and
- a valve 42, which is interposed along fluidic line 40 and can be selectively set in an open position in which it fluidly connects vacuum collector 41 with opening 14, or in a closed position, in which it fluidly isolates collector 41 and opening 14.

In case of filling with a carbonated product, valve is set in the open position, during the de-pressurization step of article 2, while is set in the closed position while the other operations are carried out on article 2.

Furthermore, body 10 comprises

- a fluidic line 50, which extends between a section 43 of fluidic line 40 and a vacuum collector 51;
- a valve 52, which is interposed along fluidic line 50 and can be selectively set in an open position (FIG. 2) in which it fluidly connects vacuum collector 51 with opening 14 and a closed position (FIGS. 1 and 3 to 7) in which it fluidly isolates collector 51 and opening 14.

Section 43 is, in particular, interposed between valve 42 and opening 14 along fluidic line 40.

In other words, fluidic line 50 is formed as a derivation of fluidic line 40.

Section 43 is fluidly connected with opening 14 also when shutter 15 is in the closed position. In particular, fluidic line 40 opens into opening 14 below the position reached by shutter 15 in the closed position.

In case of filling with a carbonated product, valve is set in the open position during the vacuum generation step of article 2, and is set in the closed position during the other operations on article 2.

Filling device 17 preferably comprises a flow-meter 80, which is arranged along a duct 81 extending between tank 13 and opening 12, and is adapted to measure the flow Q—and, therefore, the quantity—of pourable product filled inside article 2, when shutter 15 is in the open position.

Filling station 4 comprises a control unit 60 (only schematically shown in FIGS. 1 to 5), which is programmed for controlling shutters 15, valves 22, 23 and valves 42, 52 and supports 20 of all filling devices 17.

With special reference of filling of article 2 with a still product, control unit 60 is advantageously programmed for (FIG. 3), when supports 20 are in the respective raised position:

i) setting valves 22, 23 in the closed position;

ii) setting shutter 15 in the open position during step i); and iii) detecting that article 2 is defective, e.g. is holed, when flow Q is greater than a threshold value during steps i) and ii).

It is important to stress that when valves 22, 23 are in the respective closed position, the air contained in article 2 is prevented from flowing along duct 24 and, therefore, from escaping from article 2. Accordingly, the pourable product is prevented from entering article 2 and, therefore, flow Q should theoretically equal to zero. However, flow Q is slightly more than zero due to the elasticity of the air contained inside article 2, which allows a small amount of pourable product to enter article 2.

Furthermore, control unit 60 is programmed for carrying out steps i) and ii) during an interval time t1 (FIG. 2) and an interval time t2 consequent to one another, and for carrying out step iii) only during interval time t2 (FIG. 3).

In this way, during first interval time t1, the flow Q can adjust before its value is used for detecting the defective status of article 2. In particular, a small flow Q can enter article 2, due to the elasticity of the air contained therein.

Preferably, the length of first time interval t1 and/or the threshold value can be adjusted by an operator on the basis of the format of article 2 and of the desired filling level of article 2.

Finally, control unit 60 is programmed for:

iv) setting shutter 15 and valves 22, 23 in the respective open positions (FIG. 4) during a third time interval t3, so as to fill article 2 at a fast speed; and v) setting shutter 15 and valves 22, 23 in the respective closed positions (FIG. 5) during a fourth time interval t4 subsequent to time interval t3, so as to interrupt the filling of article 2.

In particular, steps iv) and v) are carried out after step iii) and time interval t3 is subsequent to time intervals t1 and t2.

A software product can be loaded onto control unit which, when executed, implements previously identified steps i)-v).

Filling station 4 further defines a single flow-meter 80 and duct 81, and single collectors 41, 51 for all filling devices 17.

The operation of the filling station 4 will be described with reference to the filling of articles 2 with a still pourable product and with reference to only one filling device 17 and article 2.

Furthermore, the operation of filling device 17 will be described as of the condition shown in FIG. 1, in which shutter 15, valves 22, 23, 42, 52 are in the respective closed positions.

In this condition, support 20 is in the rest position and mouth 8 of empty article 2 is spaced along axis A from opening 14 and body 10.

Thereafter, control unit 60 sets shutter 15 in the open position and keeps valves 22, 23, 42, 52 in respective closed positions for time intervals t1 (FIG. 2) and t2 (FIG. 3).

In this situation, mouth 8 is in tight-fluid contact with body 10 of filling device 17.

Thanks to the fact that valves 22, 23 are in the respective closed positions, the air contained in article 2 is prevented from escaping from article 2 along ducts 24, 25.

Accordingly, flow Q of pourable product should theoretically equal zero, due to the fact the pourable product is prevented from entering inside article 2.

However, due to the elasticity of the air contained in article 2, a small quantity of pourable product can enter article 2 and flow Q can be slightly greater than zero.

During time interval t1 (FIG. 2), control unit 60 does not compare flow Q detected by flow-meter 80 with threshold value. Accordingly, the flow Q can reach a regime value slightly greater than zero.

The length of time interval t1 can be selectively adjusted on the basis of at least the format and/or the desired filling level of article 2.

During time interval t2 (FIG. 3), control unit 60 compares flow Q detected by flow-meter 80 with threshold value, in order to detect whether or not article 2 is defective, i.e. is holed.

More precisely, in case flow Q is greater than the threshold value, article 2 is considered defective and discarded, so that it cannot reach labeling station 7. As a matter of fact, the fact that flow Q is greater than the threshold value means with valves 22, 23 both in respective closed positions is indicative of the fact that the pourable product enters mouth 8 and escapes from the hole of article 2.

On the contrary, in case flow Q is lower than the threshold value, article 2 is considered acceptable and filled with the still pourable product.

Afterwards, control unit 60 subsequently:

keeps shutter 15 in the open position and sets both valves 22, 23 in respective open positions for time interval t3 (FIG. 4), so as to carry out a fast filling of article 2; and sets shutter 15 and valve 22 in the respective closed positions (FIG. 5), so as to interrupt the filling of article 2.

When flow-meter 80 has detected that the correct amount of pourable product has filled article 2, control unit 60 sets shutter 15 and valve 22 in the closed position and displaces support 20 in the lowered position.

At this stage, article 2 filled with flat pourable product is discharged from support 20 and transferred from filling station 4 to transfer station 6.

The advantages of filling device 17 and the filling method according to the present invention will be clear from the above description.

In particular, in case of filling of articles 2 with still product, flow Q is measured with valves 22, 23 in the closed positions and in case flow Q is greater than a threshold value, articles 2 are considered defective and accordingly discarded.

In this way, defective, e.g. holed, articles 2 are not transferred to labeling station 7.

This is particularly advantageous when articles 2 are formed as of very light pre-forms. As a matter of fact, in this case, there is the risk that very small holes in the pre-forms are generated and are not properly detected when the pre-forms output blowing station 3.

It is therefore prevented, with reference to the traditional solutions identified in the introductory part of the present description, that defective articles 2 fall over the output conveyor of filling station 4 and cause the jamming thereof.

Furthermore, with reference to the most recently developed technical solutions indentified in the introductory part of the present description, defective articles 2 are prevented from sprinkling inside labeling station, thus causing the jamming thereof.

Filling device 17 is particularly flexible, because it can be employed, without any substantial re-designing, for contact filling both carbonated and still pourable products.

Finally, it is apparent that modifications and variants not departing from the scope of protection of the claims may be made to filling device 17 and to the filling method.

In particular, filling valve 17 could not comprise collector 21 and the pressurized gas could be stored in tank 13.

Furthermore, only one valve 22, 23 could be provided.

The invention claimed is:

1. A method for detecting the defective status of an article intended to be contact-filled with a pourable product stored in a tank using a filling device, comprising:

creating a tight-fluid contact between an opening of the article and a first fluidic line;

setting at least one second valve in a second closed position;

setting a first valve in a first open position;

measuring a flow of the pourable product along the first fluidic line;

detecting that the flow is greater than a threshold value; and detecting that the article is defective when the flow is greater than the threshold value, wherein the filling device comprises:

the first fluidic line fluidly connectable in a selective way with the tank, connected with a filling mouth of the filling device, and adapted to convey the flow of the pourable product from the tank towards the filling mouth;

the first valve interposed along the first fluidic line and adapted to be selectively arranged either in the first open position in which the first valve allows the flow of the pourable product along the first fluidic line and towards the filling mouth or in a first closed position in which the first valve prevents the pourable product from flowing along the first fluidic line;

a second fluidic line fluidly connected with the filling mouth and adapted to allow an escape of an aeriform contained in the article during filling of the article; and the at least one second valve interposed along the second fluidic line and adapted to be selectively arranged either in a second open position in which the at least one second valve allows the escape of the aeriform along the second fluidic line and away from the filling mouth or in the second closed position in which the at least one second valve prevents the aeriform from escaping flowing along the second fluidic line.

2. The method of claim 1, wherein:

setting the at least one second valve in the second closed position and setting the first valve in the first open position are carried out during both a first time interval and a second time interval consecutive to one another, and detecting that the article is defective if the flow is greater than the threshold value is carried out only during the second time interval.

3. The method of claim 2, wherein setting the at least one second valve in the second open position is carried out after the second time interval.

4. The method of claim 1, wherein the threshold value is selectively adjustable.

5. The method of claim 2, wherein the first time interval is selectively adjustable.

6. The method of claim 1, wherein the pourable product is non-carbonated.

7. The method of claim 1, further comprising:

applying a label on the filled article inside a labelling station after completion of the filling of the article; and transferring the filled article to the labelling station along a curved path.

8. A non-transitory computer-readable medium containing computer-executable programming instructions and included in a control unit of a filling device for filling an article with a pourable product, which, when executed, implements the method of claim 1.

9. A filling device for contact-filling an article with a pourable product, comprising:

a filling mouth adapted to be in tight-fluid contact with an opening of the article during filling of the article;

a first fluidic line fluidly connectable in a selective way with a tank, connected to the filling mouth, and adapted to convey a flow of the pourable product from the tank towards the filling mouth;

a first valve interposed along the first fluidic line and adapted to be selectively arranged either in a first open position in which the first valve allows the flow of the pourable product along the first fluidic line and towards the filling mouth or in a first closed position in which the first valve prevents the pourable product from flowing along the first fluidic line;

a second fluidic line fluidly connected with the filling mouth and adapted to allow an escape of an aeriform contained in the article during the filling of the article;

at least one second valve interposed along the second fluidic line and adapted to be selectively arranged either in a second open position in which the at least one second valve allows the escape of the aeriform along the second fluidic line and away from the filling mouth or in a second closed position in which the at least one second valve prevents the aeriform from escaping along the second fluidic line;

a measuring device adapted to measure a quantity associated with the flow of the pourable product along the first fluidic line; and a control unit programmed for:

setting the at least one second valve in the second closed position;

setting the first valve in the first open position; and detecting that the article is defective if the flow is greater than a threshold value.

10. The filling device of claim 9, wherein the control unit is further programmed for:

keeping the at least one second valve in the second closed position and the first valve in the first open position for a first time interval and a second time interval consecutive to one another; and detecting whether or not the article is defective only during the second time interval.

11. The filling device of claim 10, wherein the control unit is further programmed for setting the at least one second valve in the second open position after the second time interval.

12. The filling device of claim 10, wherein the threshold value is adjustable.

13. The filling device of claim 9, wherein the pourable product is non-carbonated.

14. The filling device of claim 10, wherein the first time interval is selectively adjustable.

15. A system for manufacturing articles filled with a pourable product, comprising:

a filling station adapted to fill the articles with the product;

a labelling station adapted to apply a plurality of labels onto the articles and arranged downstream of the filling station, proceeding according to an advancing direction of the articles; and a transfer station interposed between the filling station and the labelling station and adapted to transfer the articles along a path from the filling station to the labelling station, wherein the filling station, the labelling station, and the transfer station are housed inside a single machine, and the filling station comprises a plurality of filling devices according to claim 9.

* * * * *